United States Patent [19]

Yasuyoshi

[11] Patent Number: 4,744,194

[45] Date of Patent: May 17, 1988

[54] METHOD OF LAYING TILE-LIKE FLOORING MEMBERS ON A FLOOR

[75] Inventor: Tone Yasuyoshi, Yokohama, Japan

[73] Assignee: Saami Co., Ltd., Tokyo, Japan

[21] Appl. No.: 858,440

[22] PCT Filed: Aug. 16, 1985

[86] PCT No.: PCT/JP85/00454

§ 371 Date: Apr. 14, 1986

§ 102(e) Date: Apr. 14, 1986

[87] PCT Pub. No.: WO86/01246

PCT Pub. Date: Feb. 27, 1986

[30] Foreign Application Priority Data

Aug. 20, 1984 [JP] Japan ..... 59-173045

[51] Int. Cl.[4] ..... E04B 1/00

[52] U.S. Cl. ..... 52/747; 52/126.6; 52/778; 52/488

[58] Field of Search ..... 52/747, 483, 488, 777, 52/778, 385, 386, 177, 318, 480, 481; 404/34, 43, 40

[56] References Cited

U.S. PATENT DOCUMENTS

| | | | |
|---|---|---|---|
| 350,101 | 10/1886 | Bates | 404/34 |
| 2,049,427 | 8/1936 | Denk | 52/747 X |
| 2,293,431 | 8/1942 | Frease | 52/488 |
| 3,153,304 | 10/1964 | Evangelista | 52/778 X |
| 3,157,254 | 11/1964 | Spiselman et al. | 52/126.6 X |
| 3,685,235 | 8/1972 | Lang | 52/488 X |
| 4,561,232 | 12/1985 | Gladden, Jr. et al. | 52/385 |

FOREIGN PATENT DOCUMENTS

| | | |
|---|---|---|
| 50-11705 | 4/1975 | Japan . |
| 51-3613 | 2/1976 | Japan . |
| 51-66129 | 6/1976 | Japan . |
| 52-51691 | 11/1977 | Japan . |
| 52-48569 | 11/1977 | Japan . |
| 57-97038 | 6/1982 | Japan . |

*Primary Examiner*—Carl D. Friedman
*Assistant Examiner*—Creighton Smith
*Attorney, Agent, or Firm*—Birch, Stewart, Kolasch & Birch

[57] ABSTRACT

A method of laying tile-like flooring members on a floor surface including forming on the surface an interconnected framework of a plurality of frame members to provide an array of recesses(11). In each recess a tile-like flooring member is laid having on its undersurface a projection (71) for snugly engaging the recess(11). Projecting edges of the flooring members extend over the frame members to engage each other and together form a continuous floor covering. The arrangement has the advantage of flooring effectively with carpet on a floor surface of an office room where a number of office apparatus are located with entangled creeping cables which shall be rearranged often afterwards.

26 Claims, 10 Drawing Sheets

FIG. 5
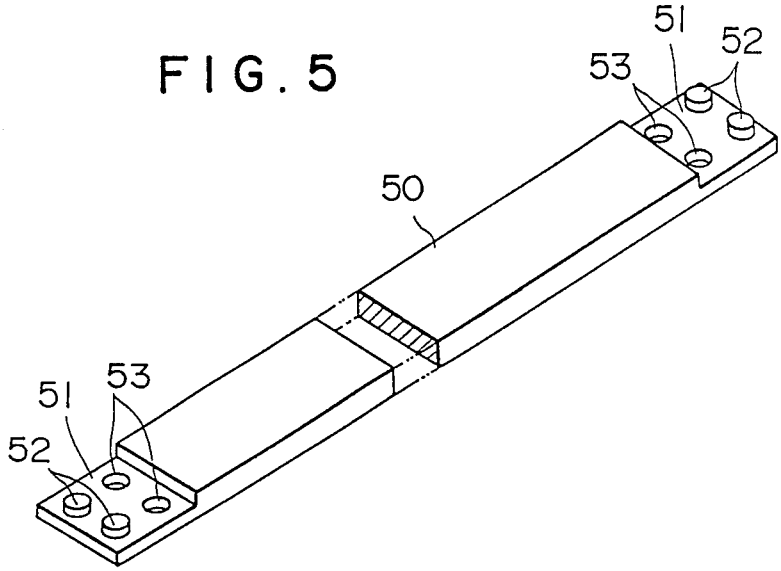
FIG. 6 (a)
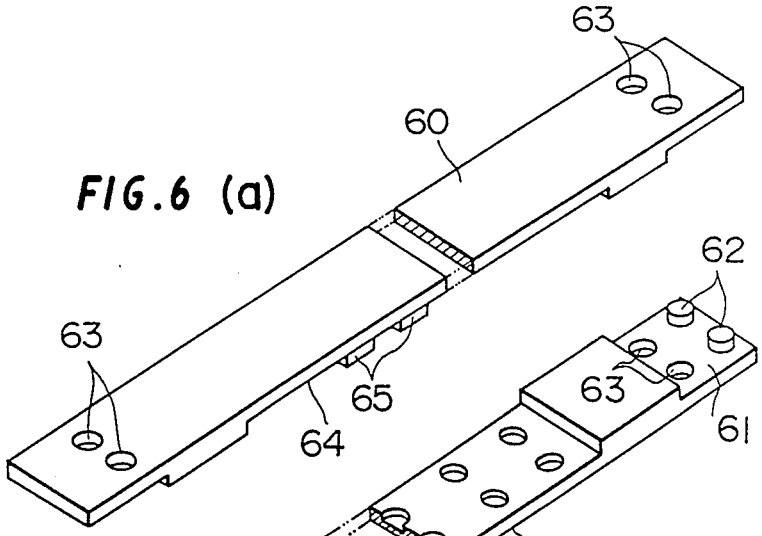
FIG. 6(b)
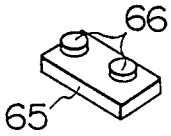
FIG. 6(c)

METHOD OF LAYING TILE-LIKE FLOORING MEMBERS ON A FLOOR

TECHNICAL FIELD

This invention relates to a method of laying tile-like flooring members, such as pieces of carpets, flooring boards, etc., on the surface of a floor.

BACKGROUND ART

In laying such tile-like members on a floor, each piece must be laid one by one. In this process, however, the members are apt to slide, or to expand or contract according to changes in the temperature. As a result there is a tendency to develop gaps between neighbouring pieces, or wrinkle in the pieces, with consequential deterioration of the appearance of the finished floor.

It is known to apply an adhesive agent or double coated adhesive tape to edge portions of the pieces being laid, to establish their positions firmly and avoid irregularities. However, this practice is very time consuming, and moreover, it is difficult to lay down a large number of tile-like flooring pieces precisely in this way, because there is a dimensional tolerance in the manufacturing of the tile-like pieces themselves.

Further, it is difficult to remove or rearrange the pieces. They cannot be conveniently removed, since the adhesive agent remains on the surface of the floor, even if the tile-like pieces have been peeled away. Moreover, in an office there will often be electric power and telephone cables as well as cables connecting office appliances to be arranged to extend across the floor.

The principal object of the present invention is to provide a method of laying tile-like flooring members in a manner that enables a large number of such members to be laid easily and precisely.

A second object of the invention is to provide a method that facilitates removal or rearrangement of the members.

A third object of the invention is to provide a method of laying tile-like flooring members in a manner that enables such members to be laid without irregularities caused on the surface of the members even being applied on such a floor where electric and telephone wires and cables are arranged across and rearrangement of them are often required afterwards.

DISCLOSURE OF INVENTION

To the above mentioned ends, the invention consists of a method of laying tile-like flooring members on a surface comprising forming on said surface an interconnected framework of a plurality of frame members having the same thickness as each other to provide an array of recesses, and laying in each said recess a tile-like flooring member having on its undersurface a projection for snugly engaging each said recess, projecting edges of said flooring members extending over the frame members to engage each other and together form a continuous floor covering.

Further, according to afore said method of laying tile-like flooring materials of the invention, a space is formed on the lower portion of the projection of at least one tile-like flooring material, a communicating portion is formed on the lower surface of at least one plate like frame member, and a cable is inserted through the space and the communicating portion. Whereby, it is possible to prevent irregularities on tile-like flooring materials and to rearrange easily the cables underneath the flooring materials.

BRIEF EXPLANATION OF DRAWINGS

Now, description will be made with reference to attached drawings to explain the invention further in detail.

In the drawings:

FIGS. 2–6(*a*) are perspective views of respective frame members;

FIG. 6(*b*) is a perspective view of the frame member shown in FIG. 6(*a*), as viewed from underneath;

FIG. 6(*c*) is a perspective view of a support for use with the frame member;

BEST MODE OF CARRYING OUT THE INVENTION

Figure 1:
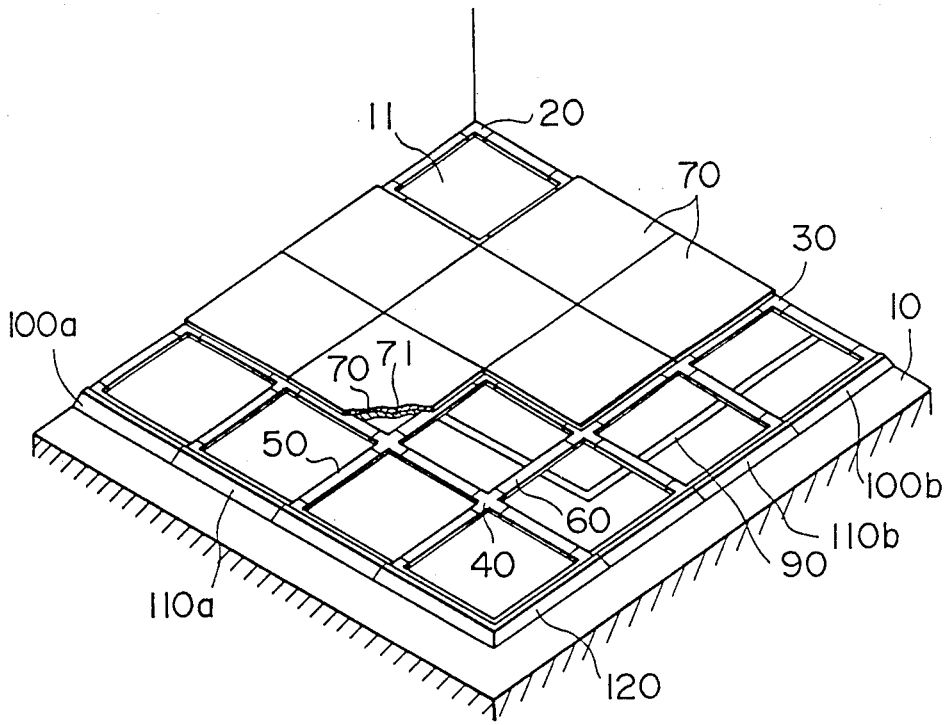
FIG. 1 is a schematic, perspective view showing a method of laying tile-like flooring members according to a first embodiment of the invention.
Figure 2:
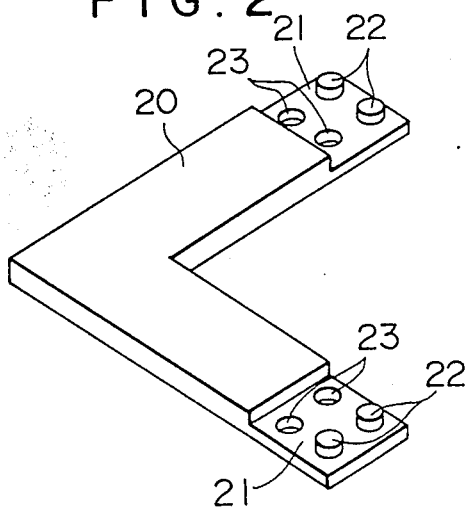
Figure 3:
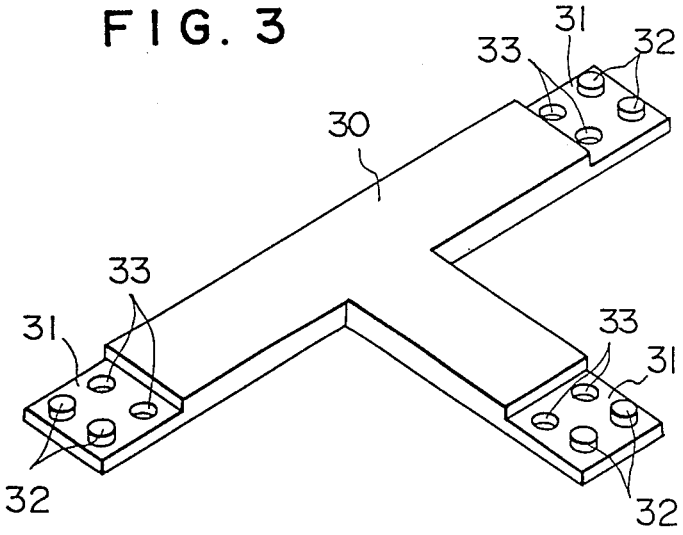
Figure 4:
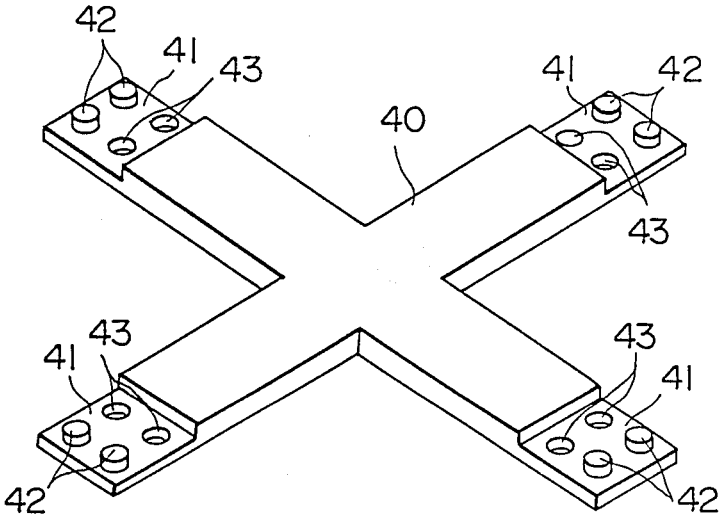

According to the method shown in FIGS. 1–9, L-shaped frame members 20 (FIG. 2), T-shaped frame members 30 (FIG. 3), cross-shaped frame members 40 (FIG. 4), rectilinear plate-like frame members of usual construction 50 and having predetermined length of special construction 60, and edge frame members 100*a*, 100*b*, 110*a*, 110*b* and 120 are connected together in a rectangular array on a floor surface 10 to form a number of identical square recesses 11.

The members 20, 30, 40, 50 and 60 have basically the same thickness and width as each other, with half-thickness, square, stepped connecting portions 21, 31, 41, 51 and 61 formed at their ends, as shown in FIGS. 2–6. A pair of projections 22, 32, 42, 52 and 62 are formed on respective connecting step portions 21, 31, 41, 51 and 61, and a pair of openings 23, 33, 43, 53, and 63 are formed at locations adjacent to projections 22, 32, 42, 52 and 62, having the size adapted to engage with projections 22, 32, 42, 52 and 62 respectively. Further, in the lower side of the plate-like frame members 60, a communicating portion 64 is formed as shown in FIG. 6 to communicate widthwise, and a plurality of engaging recesses 67 are formed in the upper inside surface of the communicating portion 64 to extend lengthwise and being spaced a predetermined distance. A supporting column member 65 shown in FIG. 6(*c*) has a block like configuration having the thickness corresponding to the height of the communicating portion 64. An engaging projection 66 is provided on the supporting column member 66 for mounting the supporting column member 65 on the communicating portion 64 of the plate-like frame member 60 by fitting the engaging portion 66 with the engaging cavities 67, as shown in FIG. 6(*b*).

Figure 7:
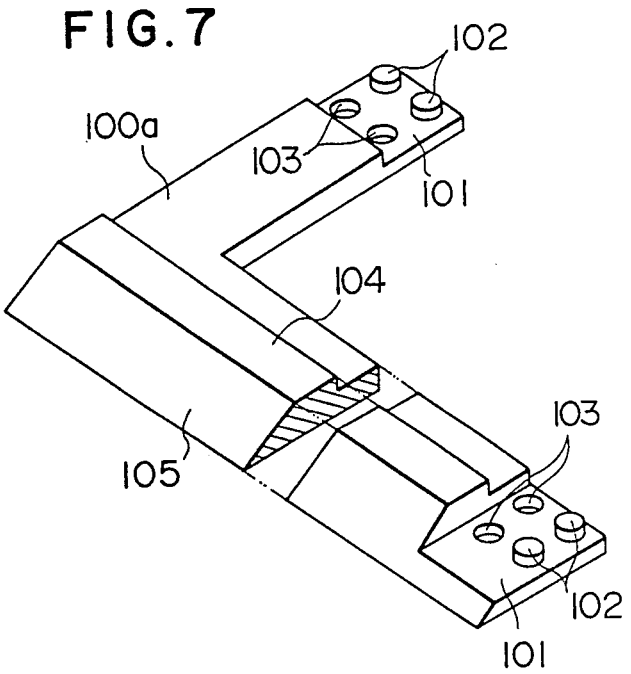
FIGS. 7–9 are perspective views of respective frame members to be employed at edge portions.
Figure 8:
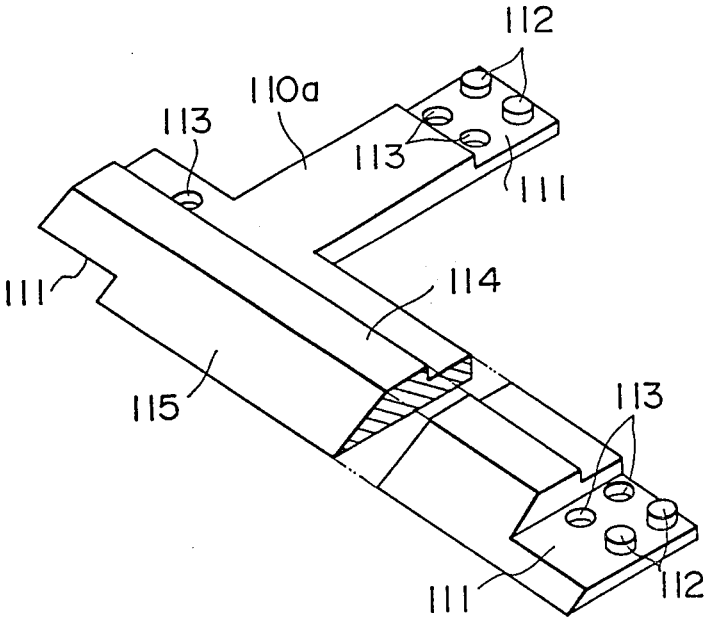
Figure 9:
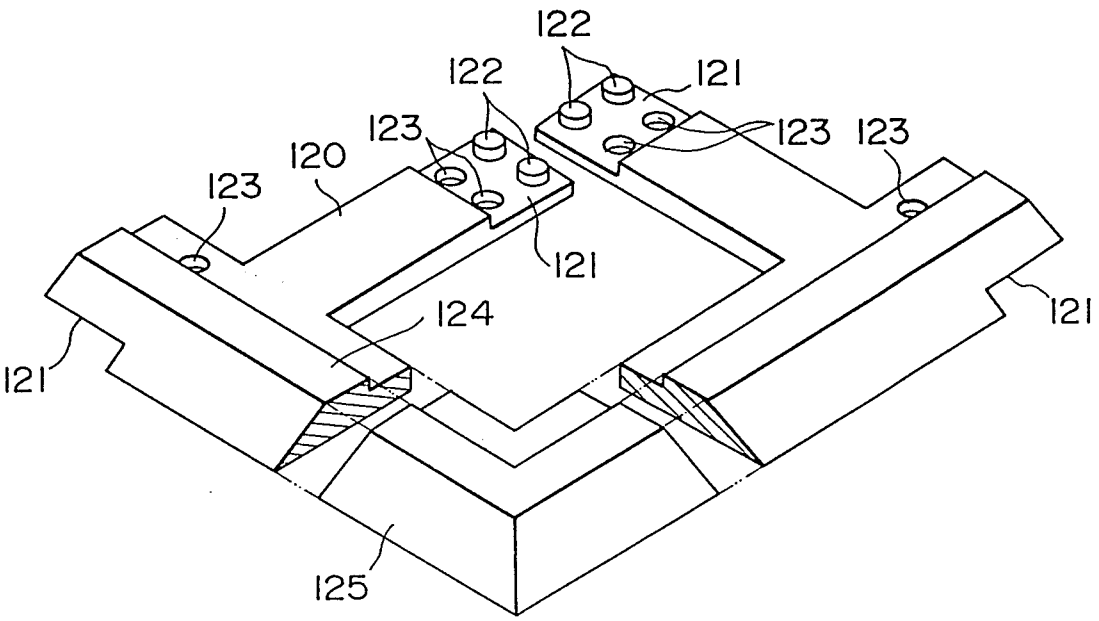

As shown in FIGS. 7–9, the edge frame members 100*a*, 110*a* and 120 are similarly formed with connecting step portions 101, 111, and 121, such connecting portions of each containing respective pairs of projections, 102, 112 and 122, and pairs of openings 103, 113 and 123. These edge frame members also define edge ridges 104, 114 and 124. The frame members 100*b* and 110*b* shown in FIG. 1 are similar to the members 100*a* and 110*a*, which are arranged on the edge portions of a floor covering area.

Figure 11:
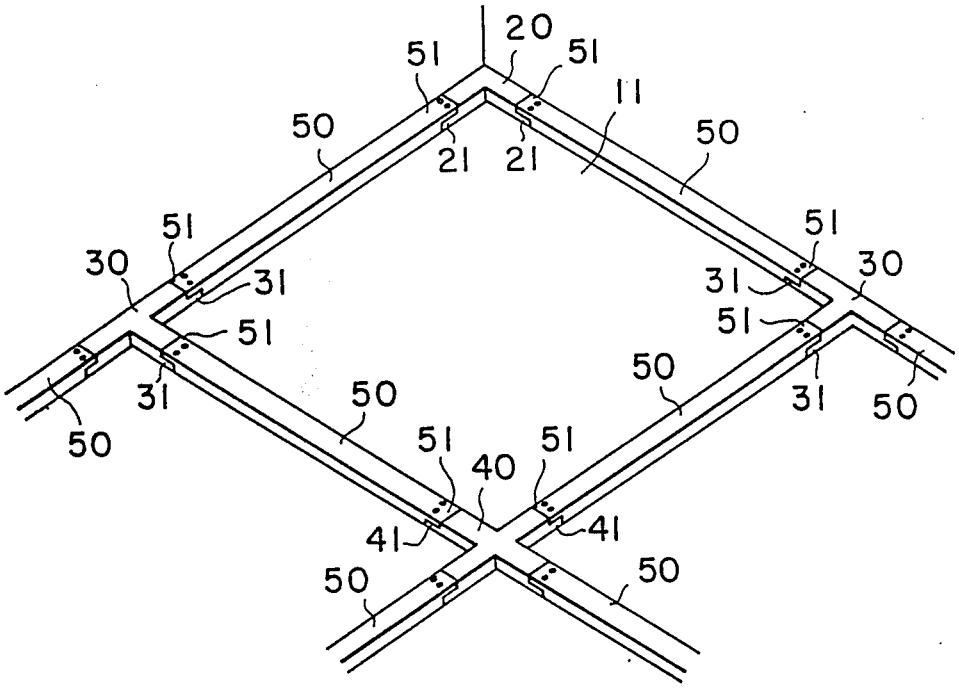
FIGS. 11–13 are explanatory views, showing a procedure according to the invention.
Figure 12:
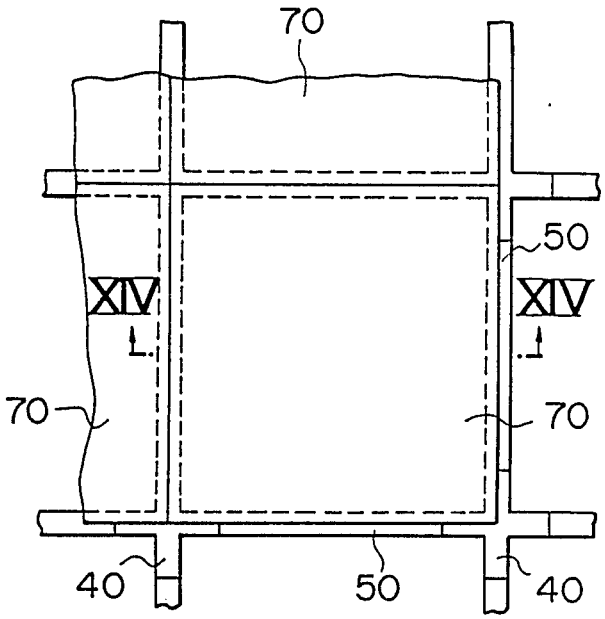
Figure 13:
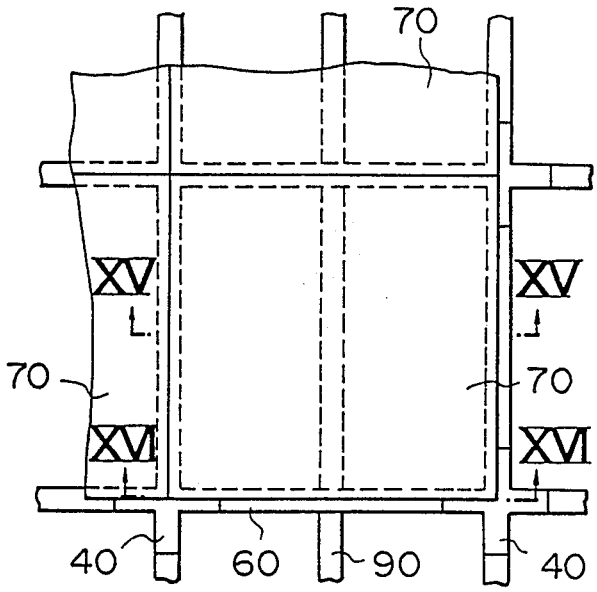
Figure 14:
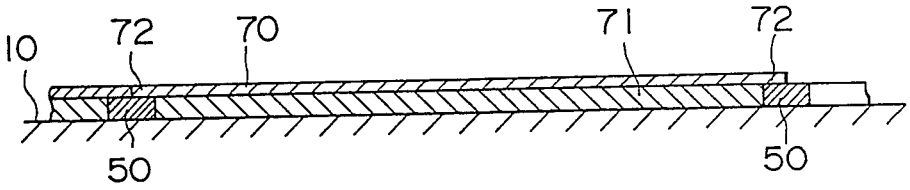
FIG. 14 is an enlarged sectional view taken along the line XIV—XIV in FIG. 12.

Referring to FIG. 11, when a floor covering is to be laid; initially a frame member 20 is placed at a beginning corner of the basic floor surface 10. The connecting portion 51 of a frame member 50 is then connected to each connecting portion 21 of the frame member 20, and so on, the entire framework shown in FIG. 11 being built up from various combinations of the frame members 30, 40, 50, 60, 100*a*, 100*b*, 110*a*, 110*b* and 120, as shown in FIGS. 3–9, connected together similarly to form a plurality of rectangular engaging recess 11 on the floor surface 10. Incidentally, respective plate like frame members are connected by engaging portions 22, 32, 42, 52, 62, 102, 112 and 122 on respective connecting step portions with openings 23, 33, 43, 53, 63, 103, 113 and 123 respectively.

Figure 16:
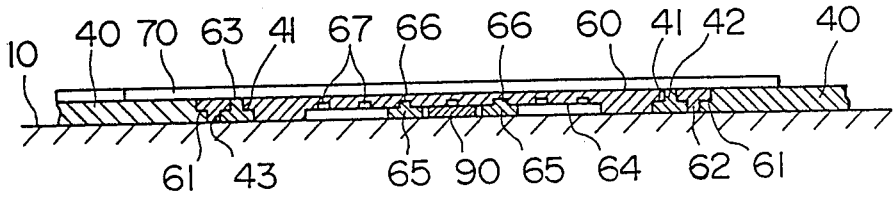
FIG. 16 is an enlarged sectional view taken along the line XVI—XVI in FIG. 13.

Assuming that a flat cable 90 (FIG. 1) is to extend across the floor surface 10, frame members 60 with recesses 64 will be used in the path of this cable to permit its passage, the supports 65 being located on each side of the cable (FIG. 16) to prevent deformation of the frame member 60 or lateral displacement of the cable.

Figure 10:
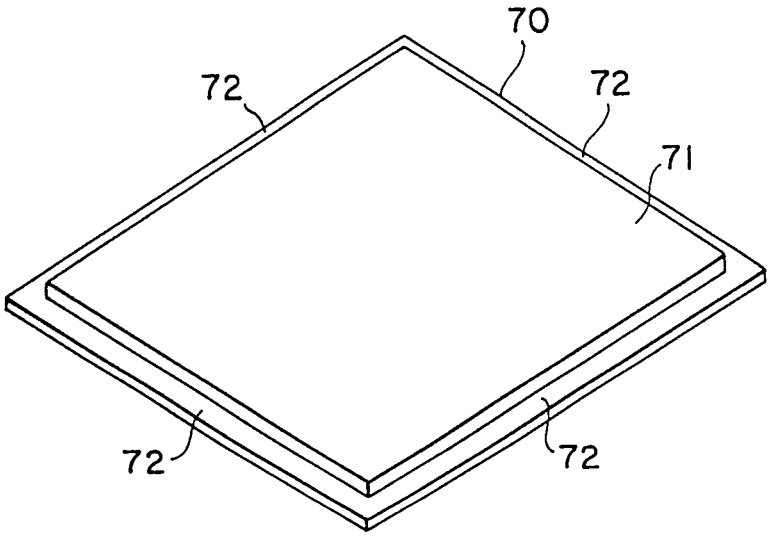
FIG. 10 is a perspective view of a tile-like flooring member, as viewed from underneath.
Figure 15:
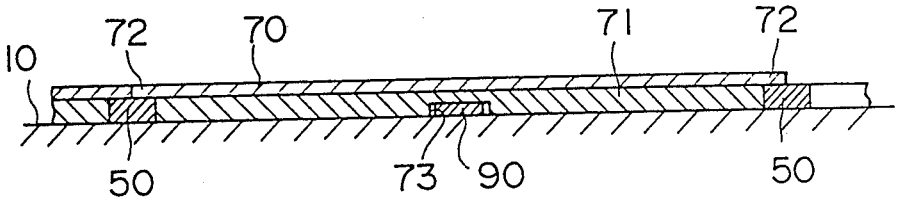
FIG. 15 is an enlarged sectional view, taken along the line XV—XV in FIG. 13.

The tile-like members 70 to be laid on a floor are shown in FIG. 10. Namely each has a projection 71 on its undersurface of the same thickness as that of all the frame members 20, 30, 40, 50, and 60, such projection 71 being smaller than the main body of the member 70 which thus has projecting edges 72. The extent of projection of each edge 72 is half the width of each frame members 20, 30, 40, 50 and 60. Thickness of the edges 72 is approximately equal to the height of the ridges 104, 114 and 124 of the edge frame members. As shown in FIGS. 12 to 15, each recess 11 formed by the framework of frame members where no cable 90 traverses, snugly receives a projection 71 of a member 70. As shown in FIG. 15, when the cable 90 is present, it is accommodated in a groove 73 formed in the projection 71 of the tile member. Because each projecting edge 72 is half the width of each frame member, the tile members abut each other at their edges without any gaps or overlap to form a continuous floor covering.

Figure 17:
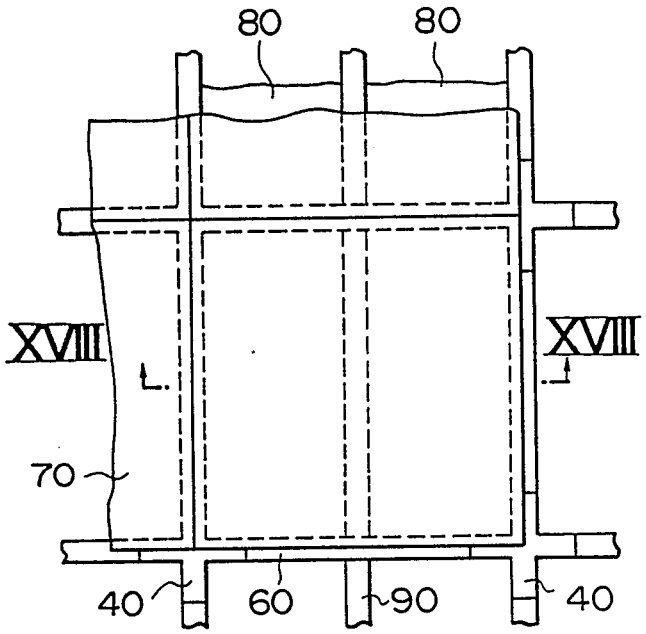
FIG. 17 is a view showing an alternative arrangement according to the present invention.
Figure 18:
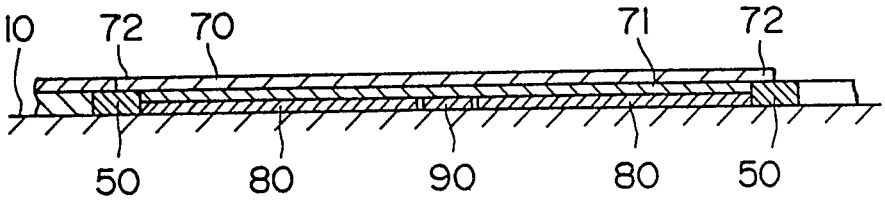
FIG. 18 is an enlarged sectional view, taken along the line XVIII—XVIII in FIG. 17.

In the alternative shown in FIGS. 17 and 18, the thickness of the projection 71 can be less than the thickness of the frame members 20, etc., in which case packing members 80 are interposed between the projection 71 and the floor 10, these members 80 being spaced to accommodate a cable 90.

Numerous alternatives are possible:

For example, according to this invention the tile-like members need not necessarily be formed of carpet material only. They could also be formed of wood, a synthetic resin, rubber material or the like.

Figure 19:
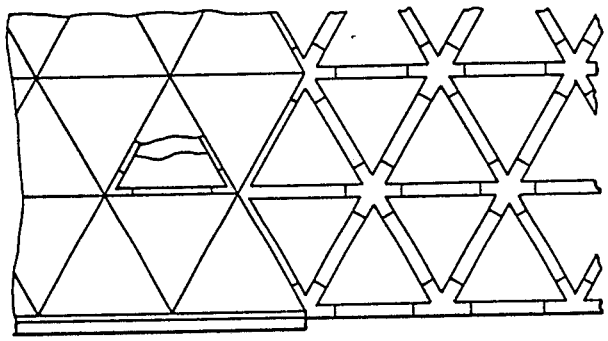
FIGS. 19–21 are explanatory views of other alternatives according to the invention.
Figure 20:
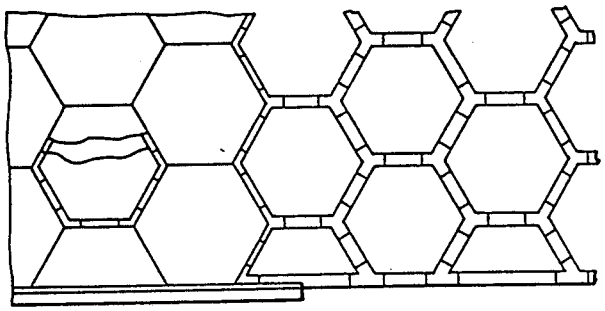
Figure 21:
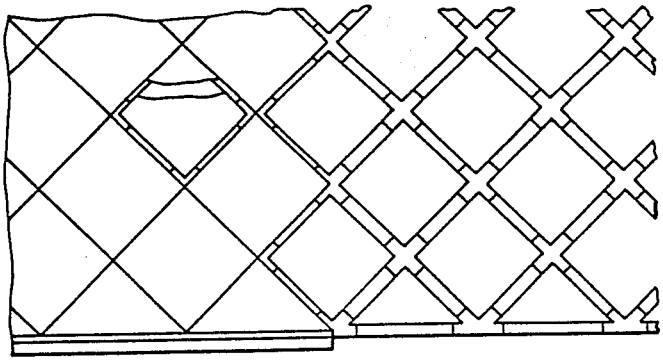

The specific configuration of the array of frame members need not necessarily be as shown in FIGS. 1 to 16. As shown in FIGS. 19 to 21, the configuration can be triangular, hexagonal or diagonally arranged squares, or other desired isometric shapes.

Instead of using edge frame members 100*a*, 100*b*, 110*a*, 110*b* and 120 as shown in FIGS. 7 to 9, such special configured frame members including raised projections on the top of members 20, 30 and 50 may be employed to engage such other type of edge members of rubber being formed with an engaging groove, ridge and inclined outside.

While the drawings show a flat cable 90, the system can be applied to a situation where optical fiber cables or other shaped cables are arranged on the floor surface 10.

Still further it is to be noted that the projecting edges 72 of the tile members 70 need not necessarily project for a distance equal to half the width of the frame members. For example, some projecting edges could extend for a different distance, say a third the width of the frame members, while others extend for two-thirds of such width, or other equivalent complementary dimensions.

It will be noted that, by means of the present invention, no bonding agent or double-side adhesive tape is required for locating the tile-like members in the recesses formed by the frame members, and it, therefore, becomes possible readily to arrange, remove and rearrange a large number of tile-like members on the floor in precisely determined positions. Even though cables may have initially been placed in one arrangement on the floor surface, it is possible to change this arrangement, inserting additional cables through spaces below frame members (such as the frame members 60), while nevertheless, avoiding irregularities of the final upper surface.

The arrangement does not represent any significant reduction in the space of the room, since the height of the tile-like members can be kept small.

INDUSTRIAL APPLICABILITY

The method for laying tile-like flooring materials according to the invention is particularly effective in removably carpeting tile-like flooring materials on a partial or whole area of a room and further is effective in carpeting tile-like flooring materials in an office room with a plurality of wires and cables of telephones, OA apparatus and the like extended on the floor.

What is claimed:

1. A method of laying tile-like flooring members on a floor surface comprising the following steps:

forming on said floor surface an interconnected framework of a plurality of plate like frame members having the same thickness as each other to provide an array of recesses with said frame members directly contacting and being supported along a substantial portion of their lengths by said floor surface, wherein ends of said frame members are connected by providing each of said ends of said frame members with connecting step portions, providing said connecting step portions with projections and openings and inserting said projections of said frame members into said openings of said frame members adjacent thereto;

laying in each said recess a tile-like flooring member having on its undersurface a projection for snugly engaging each said recess and each flooring member being supported across its length and width dimensions by said floor surface; and providing projecting edges on said flooring members extending over the frame members to engage each other and together form a continuous floor covering.

2. A method according to claim 1, wherein a space is formed in a lower portion of said projection of at least one of said tile-like flooring members, a communicating portion is formed in a lower surface of at least one of the plate like frame members to communicate in the widthwise direction, and a cable is inserted through said space and communicating portion.

3. A method according to claim 2, wherein said space is in the form of a groove.

4. A method according to claim 2, wherein the thickness of said projection is less than the thickness of the frame members, and including packing material laid on the floor surface between the floor surface and the projection, said packing material defining a passage for a cable or the like.

5. A method according to claim 2 wherein supporting members are located in the communicating portion of said at least one frame member to support the frame member on each side of the cable.

6. A method according to claim 1, and further including selecting frame members having raised ridges almost as high as the thickness of the tile-like flooring members to act as edges to the floor covering, said selected frame members having inclined outer edges.

7. A method according to claim 1, wherein said plate like frame member being arranged at an edge portion of the floor covering is formed to have a projection which snugly engages an edge member of rubber by means of a groove thereof; said edge member is formed to have a ridge almost as high as the thickness of tile-like flooring members as well as an inclined outer edge thereon.

8. A method according to claim 1, wherein each stepped portion has a pair of said projections and a pair of said openings.

9. A method according to claim 1, wherein the frame members are L-shaped, T-shaped, cross shaped and rectilinear.

10. A method according to claim 9, wherein the frame members are formed into a rectangular framework defining an array of square recesses.

11. A method according to claim 1, wherein each projecting edge of each tile-like member projects for a distance equal to approximately half the width of each frame member.

12. A method according to claim 1, wherein each tile-like member is a piece of carpet.

13. A method according to claim 1, wherein each tile-like member is a piece of flooring board.

14. A method of laying tile-like carpets on a floor surface comprising the following steps:

forming on said surface an interconnected framework of a plurality of plate like frame members having the same thickness as each other to provide an array of recesses, wherein ends of said frame members are connected by providing each of said ends of said frame members with connecting step portions, providing said connecting step portions with projections and openings and inserting said projections of said frame members into said openings of said frame members adjacent thereto, laying in each said recess a tile-like carpet having on its undersurface a projection for snugly engaging each said recess and being substantially supported by said floor surface; and providing projecting edges on said tile-like carpets extending over the frame members to engage each other and together form a continuous floor covering.

15. A method according to claim 14, wherein a space is formed in a lower portion of said projection of at least one of said tile-like flooring members, a communicating portion is formed in a lower surface of at least one of the plate like frame members to communicate in the widthwise direction, and a cable is inserted through said space and communicating portion.

16. A method according to claim 15, wherein said space is in the form of a groove.

17. A method according to claim 15, wherein the thickness of said projection is less than the thickness of the frame members, and including packing material laid on the floor surface between the floor surface and the projection, said packing material defining a passage for a cable or the like.

18. A method according to claim 15, wherein supporting members are located in the communicating portion of said at least one frame member to support the frame member on each side of the cable.

19. A method according to claim 14, and further including selecting frame members having raised ridges almost as high as the thickness of the tile-like carpets to act as edges to the floor covering, said selected frame members having inclined outer edges.

20. A method according to claim 14, wherein said plate like frame member being arranged at an edge portion of the floor covering is formed to have a projection which snugly engages an edge member of rubber by means of a groove thereof; said edge member is formed to have a ridge almost as high as the thickness of said tile-like carpets as well as an inclined outer edge thereon.

21. A method according to claim 14, wherein the frame members are L-shaped, T-shaped, cross shaped and rectilinear.

22. A method according to claim 21, wherein the frame members are formed into a rectangular framework defining an array of square recesses.

23. A method according to claim 14, wherein each projecting edge of each tile-like member projects for a distance equal to approximately half the width of each frame member.

24. A method according to claim 14, wherein each stepped portion has a pair of said projections and a pair of said openings.

25. A method of laying tile-like flooring members on a floor surface comprising the following steps:

forming on said surface an interconnected framework of a plurality of plate like frame members having the same thickness as each other to provide an array of recesses;

laying in each said recess a tile-like flooring member having on its undersurface a projection for snugly engaging each said recess; and providing projecting edges on said flooring members extending over the frame members to engage each other and together form a continuous floor covering;

wherein ends of said frame members are connected by providing each of said ends of said frame members with connecting step portions, providing said connecting step portions with projections and openings and inserting said projections of said frame members into said openings of said frame members adjacent thereto.

26. A method according to claim 25, wherein each stepped portion has a pair of said projections and a pair of said openings.

* * * * *